United States Patent [19]

Reynolds

[11] Patent Number: 4,778,592

[45] Date of Patent: Oct. 18, 1988

[54] DEMETALATION OF HYDROCARBONACEOUS FEEDSTOCKS USING AMINO-CARBOXYLIC ACIDS AND SALTS THEREOF

[75] Inventor: John G. Reynolds, El Cerrito, Calif.

[73] Assignee: Chevron Research Company, San Francisco, Calif.

[21] Appl. No.: 901,345

[22] Filed: Aug. 28, 1986

[51] Int. Cl.[4] ..... C10G 17/00; C10G 21/00

[52] U.S. Cl. ..... 208/252; 208/251 R; 208/309; 423/155; 423/165

[58] Field of Search ..... 208/251 R, 252, 309; 423/155, 165, 144, 150

[56] References Cited

U.S. PATENT DOCUMENTS

| | | | |
|---|---|---|---|
| 2,976,233 | 3/1961 | Selbin | 208/251 R |
| 3,052,627 | 9/1962 | Lerner | 208/251 R |
| 3,153,623 | 10/1964 | Eldib et al. | 208/251 R |
| 3,167,500 | 1/1965 | Payne | 208/251 R |
| 3,317,421 | 5/1967 | Gleem et al. | 208/251 H |
| 3,322,664 | 5/1967 | Paterson et al. | 208/48 |
| 3,449,243 | 6/1969 | Strong, Jr. et al. | 208/251 R |
| 4,280,897 | 7/1981 | Shah et al. | 208/113 |
| 4,431,524 | 2/1984 | Norman | 208/252 |
| 4,432,865 | 2/1984 | Norman | 208/252 |
| 4,439,345 | 3/1984 | Duke | 252/330 |
| 4,539,099 | 9/1985 | Merchant et al. | 208/251 R |
| 4,568,450 | 2/1986 | Tiny et al. | 208/251 H |

FOREIGN PATENT DOCUMENTS

| | | | |
|---|---|---|---|
| 1642497 | 6/1962 | Canada | 208/252 |

*Primary Examiner*—Asok Pal
*Assistant Examiner*—Helane Myers
*Attorney, Agent, or Firm*—S. R. La Paglia; T. G. DeJonghe; Q. T. Dickinson

[57] ABSTRACT

A process is disclosed for the demetalation of organically-bound compounds of Group VIII metals, particularly iron, from hydrocarbonaceous feedstock. In the process, an aqueous solution of amino-carboxylic acid, or salts, particularly EDTA, is used to form complexes with the metals and extract them from the feedstock. The aqueous phase containing the complexed metals contaminants is then separated from the hydrocarbonaceous phase.

12 Claims, No Drawings

DEMETALATION OF HYDROCARBONACEOUS FEEDSTOCKS USING AMINO-CARBOXYLIC ACIDS AND SALTS THEREOF

BACKGROUND OF INVENTION

This invention relates to a process for the removal of iron from iron-containing petroleum crudes, heavy hydrocarbonaceous residua, or solvent deasphalted oils derived from crudes and residua, using amino-carboxylic acids as sequestering or chelating agents. A few, but increasingly important, petroleum crude feedstocks and residua contain levels of iron which render them difficult, if not impossible, to process using conventional refining techniques. Specifically, the iron contaminants causing particular problems are in the form of non-porphyrin, organometallically-bound compounds. These species have been attributed to either naturally-occurring iron complexes or solubilized iron from the corrosion and decay of iron bearing equipment which comes in contact with crude oils. One possible class of iron-containing compounds identified in particular is the iron naphthenates and their homologous series. These organo-iron compounds are not separated from the feedstock by normal desalting processes, and, if left untreated, they can cause the very rapid deactivation of hydroprocessing catalysts in conventional refining operations. Examples of feedstocks demonstrating objectionably high levels of iron compounds are those from the San Joaquin Valley in Cailfornia. Generally, these crudes are contained in a pipeline mixture referred to as San Joaquin Valley crude or residuum.

The problems presented by iron in petroleum feedstocks, and the necessity for removing it, has been known for some time, but the prior art contains few specific references to particular solutions to its removal. Metals removal generally using organic compounds, however, has been also addressed in the prior art, but specifically for the removal of known metallic contaminants, such as nickel, vanadium, and/or copper, which are also ordinarily found in feedstocks as porphyrins, and other organometallic compounds.

In U.S. Pat. No. 3,052,637, Lerner, metals-contaminants are removed from crude petroleum feedstocks using a 2-pyrrolidone-alcohol mixture. In U.S. Pat. No. 3,167,500, Payne, metallic contaminants, such as metal-containing porphyrins, are removed from petroleum oils using a condensed polynuclear aromatic compound having a preferred C/H ratio and a molecular weight ordinarily called pitch binders. In U.S. Pat. No. 3,153,623, Eldib et al, selected commercially available organic compounds of high dielectric strength were added to assist in the electrically directed precipitation removing metals with the polar organic molecules.

It has now been unexpectedly found that the iron-containing contaminants may be effectively removed from the feedstocks of the present invention by binding the iron compounds using amino-carboxylic acids and their salts.

SUMMARY OF THE INVENTION

The process comprises of a method for demetalating hydrocarbonaceous feedstocks, particularly crude petroleum or residua using an aqueous solution of the chelating agent. The method is particularly appropriate for removing iron, especially non-porphyrin, organically-bound iron compounds. The preferred metal chelating agents are the amino-carboxylic acids, such as ethylene diamine tetraacetic acid and salts thereof in an aqueous solution. In the preferred process, the feedstock to be demetallized is intimately and thoroughly mixed with an aqueous solution of the amino-carboxylic acid, its salts, or mixtures thereof. The metals complex with the agent, and the water-soluble complex which is formed dissolves in the aqueous phase. The aqueous phase and the hydrocarbon phase are then separated and the hydrocarbonaceous feedstock is then available for hydroprocessing.

DETAILED DESCRIPTION OF THE INVENTION

Various petroleum crude feedstocks and residua produced from them contain unacceptably high levels of iron-containing metals contaminants. These organically-bound iron ions or iron-containing compounds cause distinct processing difficulties in standard hydroprocessing techniques, ordinarily by the rapid deactivation or fouling of the hydroprocessing catalyst. This invention comprises a method for removing those iron-containing contaminants prior to hydroprocessing of the crude or residua by using sequestering or chelating agents, known as amino-carboxylic acids and salts thereof.

The invention can be applied to any hydrocarbonaceous feedstock containing an unacceptably high level of iron. Those feedstocks can include crude petroleum, especially such crudes from California, including, for example, South Belridge, Huntington Beach, Wilmington or Kern River, or mixtures thereof which have particularly high metals contaminant levels. Additionally, atmospheric of vacuum residua, or solvent deasphalted oils derived from these crudes and residua, which are being increasingly hydroprocessed into more usable products, such as gas oils, gasoline, diesel fuel, etc., also have unacceptably high iron levels. It is within the contemplation of the invention that any other hydrocarbonaceous feedstocks, such as shale oil, liquefied coal, beneficiated tar sand, etc., which may contain iron contaminants, may be processed using this invention.

The basic process is relatively simple: The crude or residuum desired to be processed is mixed with an aqueous solution of the amino-carboxylic acid or a salt thereof, and a base for adjusting the pH above 2, and preferably between 5 to 9 is added. The iron is readily bound or chelated to the acid ion. This iron/amino-carboxylate complex is ionic, and is therefore soluble and removed into the aqueous phase of the mixture. The two phases, the aqueous and the crude or hydrocarbonaceous phase, are then separated or permitted to separate, and the aqueous solution containing the iron contaminant is removed. This results in an iron-free hydrocarbon feed which then can be handled in the same manner as any other carbonaceous feed and processed by conventional hydroprocessing techniques.

It is contemplated that the physical separation process is ordinarily to be done in a conventional crude oil desalter, which is usually used for desalting petroleum crudes prior to hydroprocessing. The separation may be done by any separation process, however, including countercurrent extraction.

It is well known that amino-carboxylic acids have a high affinity for iron and other metal ions. Known generically as chelating orf sequestering agents, they are a class of multidentate chelating ligands which complex or coordinate metal ions. These compounds form very stable metal ligand complexes. Common examples of these amino-carboxylic acids include: ethylene diamine tetraacetic acid (EDTA), $C_{10}H_{16}N_2O_8$, molecular weight 292.25, known also as edetic acid, N,N'-1,2-ethanediylbis[N-(carboxymethyl)glycine], or havidote; nitrilotriacetic acid (NTA), $C_6H_9NO_6$, molecular weight 191.14, also known as N,N-bis(carboxymethyl)glycine, triglycollamic acid, or triglycine; N-(hydroxyethyl)ethylene diamine triacetic acid (HEDTA), $C_{10}H_{18}N_2O_7$, molecular weight 344.22, also known as N-[2-[bis(carboxymethyl)amino]-ethyl]-N-(2-hydroxyethyl)glycine; and diethylene triamine pentaacetic acid (DTPA), $C_{14}H_{23}N_3O_{10}$, molecular weight 393.35, known also as pentetic acid, N,N-bis[2-[bis(carboxymethyl)amino]ethyl]glycine.

EDTA, NTA, and DTPa are ordinarily used as sequestering agents to remove trace metals. HEDTA is used as a laboratory sequestering agent, and NTA is used as a builder of synthetic detergents.

While amino-carboxylic acids and their salts will complex iron ions and other metal ions in aqueous solution, they appear to have little or no effect on the more commonly found, ordinary organometallic metal contaminants in petroleum, such as nickel and vanadium petroporphyrins. They do, however, have a significant effect on calcium, and amino-carboxylic acids and their salts are effective for removing organo-calcium compounds.

The salt forms of amino-carboxylic acids can be generally formed in situ by the addition of most any strong base, and can be isolated in some cases from the aqueous solution as crystalline salts. The salts are generally more water soluble, and less acidic than the free acids.

As discussed previously, in order for the iron to bind appropriately to the amino-carboxylic acids, the pH should be above 2, and preferably 5 to 9. One difficulty with the addition of base to adjust the pH, however, is the formation of emulsions which interfere with separation. Therefore, the most preferred pH is around 6, especially with naphthenic acid crudes.

The ratio of aqueous amino-carboxylic acid solution to hydrocarbonaceous feed should be optimized according to the separation method used. Commercial desalters, for example, ordinarily run at 10% or less aqueous volume. Countercurrent extraction may also be used for separation, where effective separations have been done at 50% or more aqueous volume.

The contact time between the aqueous extraction solution and the hydrocarbonaceous feed is also important, and may vary from between a few seconds to about 4 hours. The preferred contact time is from about 10 minutes to 1 hour.

The temperature at which the extraction takes place is also a factor in process efficiency. Low iron removal is found at room or ambient temperature, while moderate to high iron removal is found at elevated temperatures of, for example, 180° F. and above. The preferred temperature is above 180° F., and more preferred 300° F. and above.

EXAMPLES

In laboratory trials—the results of which are detailed in the tables below—the indicated amount of San Joaquin Valley vacuum residuum (51 ppm Fe) was dissolved in toluene to give a workable viscosity, and was mixed with a 10% to 50% aqueous volume of the amino-carboxylic acid solution. The solution was prepared by dissolving the appropriate amount of the amino-carboxylic acid in deionized $H_20$ to give the indicated mole equivalents of agent to moles of iron, and the pH was adjusted to 6 with the addition of ammonium hydroxide. A demulsifier, trade named treatolite L-1562, was added to control emulsification. The amino-carboxylic acid solution and the oil mixture were shaken or mixed and allowed to separate, preferably overnight. The residuum was analyzed before and after treatment to determine the amount of iron removed.

EXAMPLE 1

Table I indicates that elevated temperatures contribute to very high iron removal, on the order of 85%. At lower temperatures, however, moderate iron removal is still achieved.

EXAMPLE 2

Table II indicates contact time also affects high iron removal, even when high temperatures are used. At shorter contact times, however, moderate iron removal is still achieved.

EXAMPLE 3

For comparative purposes, Table III lists iron removal from San Joaquin Valley vacuum residuum by conventional desalting solutions. Little iron removal activity is afforded by these agents.

TABLE 1

Iron Removal From San Joaquin Valley Vacuum Residuum With EDTA; Temperature Dependence (pH 6)

| Temp, °F. | Mole EDTA Mole Fe | Aqueous Vol, % | Mix Time, min | % Fe Removal |
|---|---|---|---|---|
| 70 | 30 | 50 | 1 min | 30 |
| 180 | 25 | 50 | 60 min | 60 |
| 200 | 16.5 | 50 | 240 min | 68 |
| 300 | 2.2 | 50 | 60 min | 86 |

TABLE II

Iron Removal From San Joaquin Valley Vacuum Residuum With EDTA; Mixing Time Dependence (pH 6)

| Mix Time, Min. | Temp. °F. | Mole EDTA Mole Fe | Aqueous Vol, % | % Fe Removal |
|---|---|---|---|---|
| 15 | 300 | 3.0 eq. | 50 | 60 |
| 30 | 300 | 3.0 eq. | 50 | 65 |
| 60 | 300 | 3.0 eq. | 50 | 86 |

TABLE III

Iron Removal From San Joaquin Valley Vacuum Residuum With Conventional Desalting Agents

| Agent | Mole Agent Mole Fe | Aqueous Vol, % | % Fe Removal |
|---|---|---|---|
| Hydrochloric Acid | 6,650 | 66 | 30 |
| Ammonium Hydroxide | Large excess | 66 | 12 |
| Water | 200,000 | 16 | 15 |

What is claimed is:

1. An aqueous extraction method for demetalizing Group VIII metals from hydrocarbonaceous feedstock said process comprising:

mixing said hydrocarbonaceous feedstock with an aqueous solution of a metals sequestering agent, wherein said metals sequestering agent comprises amino carboxylic acids, salts thereof, or mixtures thereof; and separating the substantially demetalized hydrocarbonaceous feedstock from the aqueous solution; wherein the feedstock to be demetalated is selected from the group consisting of crude petroleum, atmospheric or vacuum residua, solvent deasphalted oil derived from these crudes or residua, shale oil, liquified coal, and tar sand effluent.

2. The method as claimed in claim 1 wherein the metal is iron.

3. The method as claimed in claim 1 wherein the metals are organometallically-bound, non-porphyrin compounds.

4. The method as claimed in claim 3 wherein the compounds are compounds of iron.

5. The method as claimed in claim 1 or 3 wherein the said metals sequestering agents are selected from the group consisting of nitrilotriacetic acid (NTA), N-(hydroxyethyl)ethylene diamine triacetic acid (HEDTA), diethylene triamine pentaacetic acid (DTPA), and ethylene diamine tetraacetic acid (EDTA) and salts thereof.

6. The method as claimed in claim 1 or 3 wherein the pH of the mixing step is adjusted to 2 or above.

7. The method as claimed in claim 6 wherein, the pH of the mixing step is adjusted to 5 or above.

8. The method as claimed in claim 1 or 3 wherein the mixing temperature is 180° F. or above.

9. The method as claimed in claim 8 wherein the mixing temperature is about 300° F.

10. The method as claimed in claim 1 or 3 wherein the mixing time is about 10 minutes or more.

11. The method as claimed in claim 10 wherein the mixing time is about 1 hour.

12. The method as claimed in claim 1 where said separating is performed by a conventional crude oil desalting process or countercurrent extraction.

* * * * *

UNITED STATES PATENT AND TRADEMARK OFFICE

CERTIFICATE OF CORRECTION

PATENT NO. : 4,778,592

DATED : October 18, 1988

INVENTOR(S) : John G. Reynolds

It is certified that error appears in the above-identified patent and that said Letters Patent are hereby corrected as shown below:

Claim 1, Col. 5, Line 3, "substantially demetalized" should read --substantially demetalated"

Signed and Sealed this

Fourteenth Day of March, 1989

*Attest:*

DONALD J. QUIGG

*Attesting Officer*

*Commissioner of Patents and Trademarks*